US005677005A

United States Patent [19]

Isobe et al.

[11] Patent Number: 5,677,005

[45] Date of Patent: Oct. 14, 1997

[54] METHOD FOR HOT DIP GALVANIZING HIGH TENSILE STEEL STRIP WITH MINIMAL BARE SPOTS

[75] Inventors: Makoto Isobe; Nobue Fujibayashi; Kazuaki Kyono; Nobuo Totsuka, all of Okayama; Nobuyuki Morito, Chiba, all of Japan

[73] Assignee: Kawasaki Steel Corporation, Japan

[21] Appl. No.: 381,971

[22] PCT Filed: Jun. 24, 1994

[86] PCT No.: PCT/JP94/01017

§ 371 Date: Feb. 13, 1995

§ 102(e) Date: Feb. 13, 1995

[87] PCT Pub. No.: WO95/00675

PCT Pub. Date: Jan. 5, 1995

[30] Foreign Application Priority Data

| | | | |
|---|---|---|---|
| Jun. 25, 1993 | [JP] | Japan | 5-155110 |
| Feb. 28, 1994 | [JP] | Japan | 6-029775 |
| Feb. 28, 1994 | [JP] | Japan | 6-029776 |

[51] Int. Cl.[6] ..... B05D 3/02

[52] U.S. Cl. ..... 427/319; 427/376.8; 427/431; 427/432

[58] Field of Search ..... 427/319, 376.8, 427/431, 432

[56] References Cited

U.S. PATENT DOCUMENTS

| | | | |
|---|---|---|---|
| 4,143,184 | 3/1979 | Paulus et al. | 427/300 |
| 4,415,415 | 11/1983 | Zaremski | 204/141.5 |
| 5,175,026 | 12/1992 | Bertol et al. | 427/307 |

FOREIGN PATENT DOCUMENTS

| | | | |
|---|---|---|---|
| 0 523 809 | 1/1993 | European Pat. Off. | C23C 2/12 |
| 2346463 | 10/1977 | France . | |
| 52-138013 | 11/1977 | Japan . | |
| 3-61352 | 3/1991 | Japan . | |
| 3-207845 | 9/1991 | Japan . | |
| 3-243751 | 10/1991 | Japan . | |
| 05 156367 | 6/1993 | Japan | C21D 9/46 |
| 6-41708 | 2/1994 | Japan . | |

*Primary Examiner*—Benjamin Utech
*Attorney, Agent, or Firm*—Austin R. Miller

[57] ABSTRACT

In connection with the manufacture of zinc hot dip galvanized or galvannealed steel strip using a high strength, high tensile steel strip containing Si, Mn or Cr as a starting steel strip, the invention provides a method for hot dip galvanizing a high tensile steel strip with minimal bare spots which can manufacture a bare spot-free steel strip of quality in an inexpensive manner while minimizing process complications and lowered productivity. The invention is achieved by subjecting a cold rolled steel strip containing at least one component of 0.1 to 2.0% of Si, 0.5 to 2.0% of Mn, and 0.1 to 2.0% of Cr and optionally further containing up to 0.2% of P, in % by weight, to recrystallization annealing in a continuous annealing line, cooling the steel strip, removing a steel component concentrated layer at the surface of the steel strip by polishing and/or pickling, subjecting the steel strip again to heat reduction at a temperature from 650° C. to a recrystallization temperature and to hot dip galvanizing in a continuous galvanizing line, and optionally effecting overplating and/or alloying or effecting alloying followed by overplating.

16 Claims, 2 Drawing Sheets

METHOD FOR HOT DIP GALVANIZING HIGH TENSILE STEEL STRIP WITH MINIMAL BARE SPOTS

FIELD OF THE INVENTION

This invention relates to a method for hot dip galvanizing high tensile steel strips with minimal bare spots which starts with high tensile steel strips for use in automobile bodies and manufactures hot dip galvanized and galvannealed steel strips.

BACKGROUND ART

Heretofore, various surface treated steel strips having improved corrosion resistance have been used as automotive steel strips. Among them, widespread are galvanized steel strips which are manufactured in a continuous hot dip galvanizing line wherein recrystallization annealing and galvanizing are carried out in a common line, because of a high degree of corrosion resistance and low cost manufacture as well as galvannealed steel strips which are manufactured by subjecting the galvanized steel strips to heat treatment, because of weldability and press workability in addition to corrosion resistance.

Meanwhile, a global environment problem is recently highlighted and it is urgently required to reduce the weight of automobiles for fuel consumption improvement. With this target, high strength/high tensile steel strips whose strength is increased were developed. Zinc hot dip galvanizing and galvannealing are now required for providing corrosion resistance.

High tensile steel strips are increased in strength by adding Si, Mn, Cr or the like to steel. In manufacturing zinc hot dip galvanized steel strips through a continuous galvanizing line (abbreviated as CGL, hereinafter), the components added for strength enhancement tend to concentrate at the steel strip surface during annealing reduction. These elements as oxides form an oxide film at the surface.

As a consequence, a significant loss of wettability occurs between steel strip and molten zinc, resulting in bare spots, uncoated defects or uncovered defects.

Prior art methods devised for preventing generation of bare spots include a method of electroplating steel strip prior to its entry into CGL (see JP-A 194156/1990) and a method of providing a surface layer of steel having a low content of Si, Mn or the like by a cladding technique for improving plating wettability (see JP-A 199363/1991). Also proposed is a method of further adding Ti to steel for improving wettability to molten zinc (see JP-A 148073/1992).

Although hot dip galvanizing of a high strength steel strip containing Si, Mn or the like becomes possible by carrying out electroplating of a Ni or Fe system on the steel strip prior to its entry into CGL, there are accompanying drawbacks including addition of an electroplating plant, complication by an increased number of steps, and low productivity. The platability improvement by cladding also complicates the process and invites a lowering of productivity.

Further, from the standpoint of increasing the speed of movement of phosphorus-added steel during manufacture of a hot dip galvannealed steel strip, JP-A 243751/1991 discloses a method of pickling annealed phosphorus-added steel to remove a P-concentrated layer for promoting alloying. However, bare spots on steel strips having Si, Mn or Cr added thereto, to which the present invention addresses, cannot be eliminated merely by removing P from the steel strip surface after annealing, as will be described later.

More particularly, what is disclosed in JP-A 243751/1991 is merely to remove a P-concentrated layer by pickling to improve the alloying rate of P-added steel thereby increasing the manufacturing speed of steel during production of a hot dip galvannealed steel strip. However, no consideration is given to bare spots associated with steel strips having Si, Mn or Cr added thereto, which this invention addresses. Accordingly, even if alloying after galvanizing might be successfully promoted by removal of a P-concentrated layer pursuant to this prior art technique, generation of bare spots in a galvanized coating itself cannot be successfully prevented. This prior art technique does not attempt to improve the galvanized coating itself; thus hot dip galvannealed steel strip of quality cannot be manufactured since plating wettability is not improved and bare spots are left during hot dip galvanizing of a high tensile steel strip having Si, Mn or Cr added thereto, even though alloying after galvanizing is promoted by the application of this prior art technique. Therefore, the pickling for removal of a P-concentrated layer and steel strip surface cleaning treatment disclosed in JP-A 243751/1991 cannot fully prevent bare spots from occurring during hot dip galvanizing and, hence, cannot fully prevent occurrence of unacceptable galvanized steel strips. Even if alloying after galvanizing is promoted, some hot dip galvannealed steel strips can be unacceptable as a matter of course for the reason that defects are present in the galvanized coating itself.

DISCLOSURE OF THE INVENTION

An object of the present invention is to eliminate the above-mentioned problems of the prior art and in connection with the manufacture of galvanized or galvannealed steel strip using a high strength/high tensile steel strip containing Si, Mn or Cr as a starting steel strip, to provide a hot dip galvanizing method for producing a bare spot-free galvanized or galvannealed steel strip of quality in an inexpensive manner while minimizing process complication and a productivity losses.

Means for solving the above-mentioned problems according to the present invention are as described below.

We carried out measurement of a surface concentration state after recrystallization annealing of a steel strip having Si, Mn or Cr added thereto, to which the invention addresses, by glow discharge spectroscopy (GDS). FIG. 1(*a*) shows GDS spectra of a steel strip surface as recrystallization annealed. These results show that in the case of steel strip having Si, Mn or Cr added thereto, all these additive elements are concentrated at the surface.

We then supposed that it would be effective for improving plating wettability to reduce the quantity of a surface concentrated layer of additive elements upon entry of steel strip into a zinc hot dipping bath.

Then making investigations on plating wettability relative to reductive annealing conditions and surface concentrated layer quantity, we have found that when a surface concentrated layer is removed after a cold rolled high tensile steel strip is annealed at a recrystallization temperature, recurrent surface concentration of Si, Mn or Cr is unlikely to occur during reheat reduction prior to zinc hot dipping and an improvement in plating wettability is achieved.

In the high tensile steel strip having Si, Mn or Cr added thereto, to which the invention addresses, pickling alone may be effective for removing a surface concentrated layer resulting from reductive annealing (or recrystallization annealing) depending on the amount of Si, Mn or Cr added. However, if the high tensile steel strip, to which the invention addresses, has a large content of Si, Mn or Cr, pickling must be continued for a longer time by suitable means such as slowing down the line speed before the surface concentrated layer can be removed solely by pickling. Also, extended time pickling can roughen the steel strip surface to produce noticeable irregularities to adversely affect the adhesion and image clarity of galvanized and galvannealed coatings. It is then desirable to fully remove the surface concentrated layer by a polishing technique or a polishing technique combined with pickling.

FIG. 1(*b*) shows the surface concentration state as determined by GDS of a high tensile steel strip which was annealed at 850° C., polished, and further reheat reduced. Also FIG. 2 shows how the annealing temperature and the heat reducing temperature after annealing and polishing affect the surface concentration of Mn taken as an example. It is seen from these results that by removing the surface concentrated layer after annealing and effecting reheat reduction, steel strip with a minimized quantity of the surface concentrated layer can be dipped in a zinc hot dipping bath.

However, it was further found that although the steel strip from which the surface concentrated layer had been removed was subjected to reheat reduction and introduced into a zinc hot dipping bath, many bare spots appeared when the reheat reducing temperature was in the range of from about 450° C. to the zinc hot dipping bath temperature to about 600° C., and galvanized coatings with minimal bare spots were obtained only when the reheat reducing temperature exceeded 650° C. (see FIG. 3).

Accordingly, we first discovered that by cold rolling a steel strip, subjecting it to recrystallization annealing in a continuous annealing line (abbreviated as CAL, hereinafter) adapted for manufacture of annealed steel strips with high efficiency, removing a concentrated layer of a steel component such as Si, Mn and Cr from the surface by polishing, pickling or a combination of polishing and pickling, and subjecting the steel strip again to reheat reduction at a temperature between 650° C. and the recrystallization temperature in a CGL, subsequent hot dip galvanizing can be successfully carried out without generating bare spots.

More specifically, the present invention provides a method for hot dip galvanizing a high tensile steel strip with minimal bare spots, characterized by subjecting a cold rolled steel strip containing at least one component selected from the group consisting of 0.1 to 2.0% of Si, 0.5 to 2.0% of Mn, and 0.1 to 2.0% of Cr, in % by weight, to recrystallization annealing in a continuous annealing line, cooling the steel strip, removing a steel component concentrated layer at the surface of the steel strip, and subjecting the steel strip again to heat reduction at a temperature between 650° C. and a recrystallization temperature and to a hot dip galvanizing in a continuous galvanizing line.

Also the present invention provides a method for hot dip galvanizing a high tensile steel strip with minimal bare spots, characterized by subjecting a cold rolled steel strip containing at least one component selected from the group consisting of 0.1 to 2.0% of Si, 0.5 to 2.0% of Mn, and 0.1 to 2.0% of Cr and further containing up to 0.2% of P, in % by weight, to recrystallization annealing in a continuous annealing line, cooling the steel strip, removing a steel component concentrated layer at the surface of the steel strip, and subjecting the steel strip again to heat reduction at a temperature between 650° C. and a recrystallization temperature and to a hot dip galvanizing in a continuous galvanizing line.

In each of the above-mentioned embodiments of the invention, the step of removing a steel component concentrated layer is preferably carried out by pickling or polishing or a combination of polishing and pickling.

Also the present invention provides a method for hot dip galvanizing a high tensile steel strip with minimal bare spots according to each of the embodiments, characterized in that after the galvanizing step, overplating is further effected.

Further the present invention provides a method for hot dip galvanizing a high tensile steel strip with minimal bare spots according to each of the embodiments, characterized in that the galvanized high tensile steel strip is further subject to alloying.

Also contemplated herein is a method for hot dip galvanizing a high tensile steel strip with minimal bare spots according to each of the embodiments, characterized in that after alloying, overplating is further effected.

BEST MODE FOR CARRYING OUT THE INVENTION

Figure 1A:
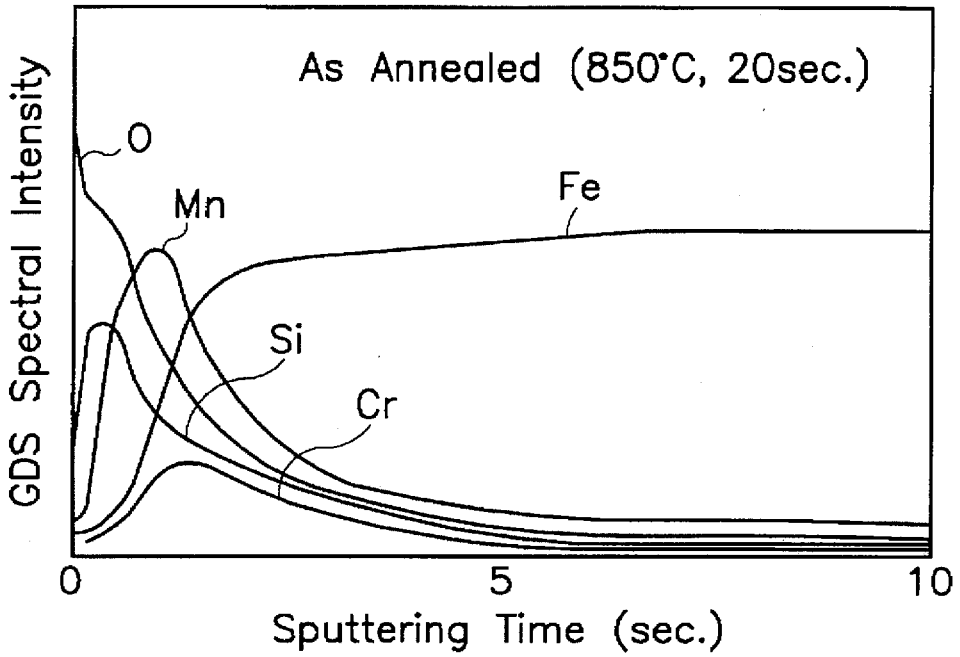
FIG. 1 shows a surface concentration state of a high tensile steel strip as determined by glow discharge spectroscopy, FIG. 1(*a*) being a diagram after annealing and FIG. 1(*b*) being a diagram after annealing-polishing-reheat reduction.
Figure 1B:
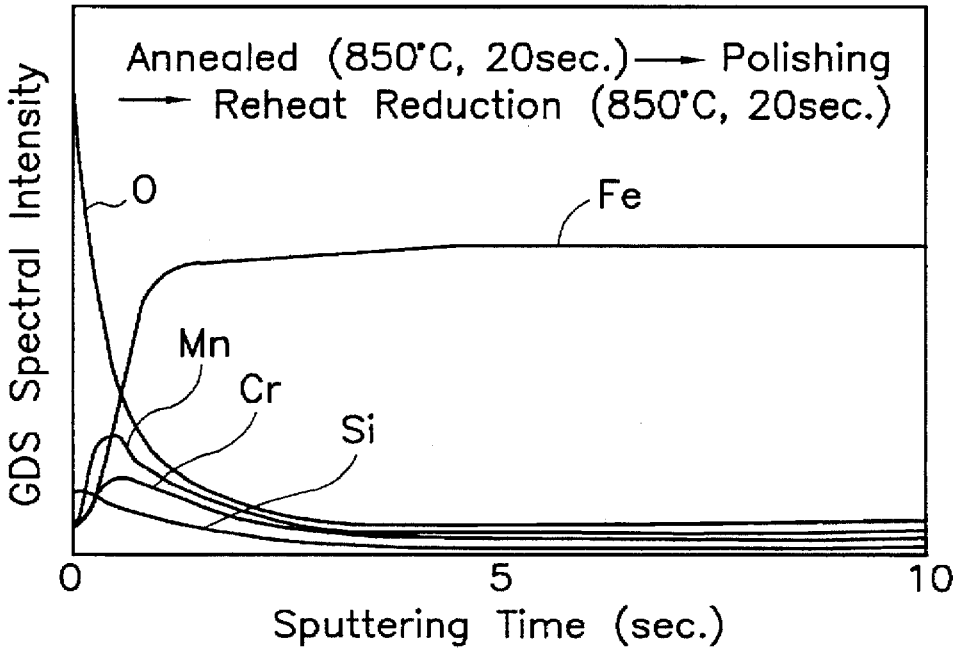
Figure 2:
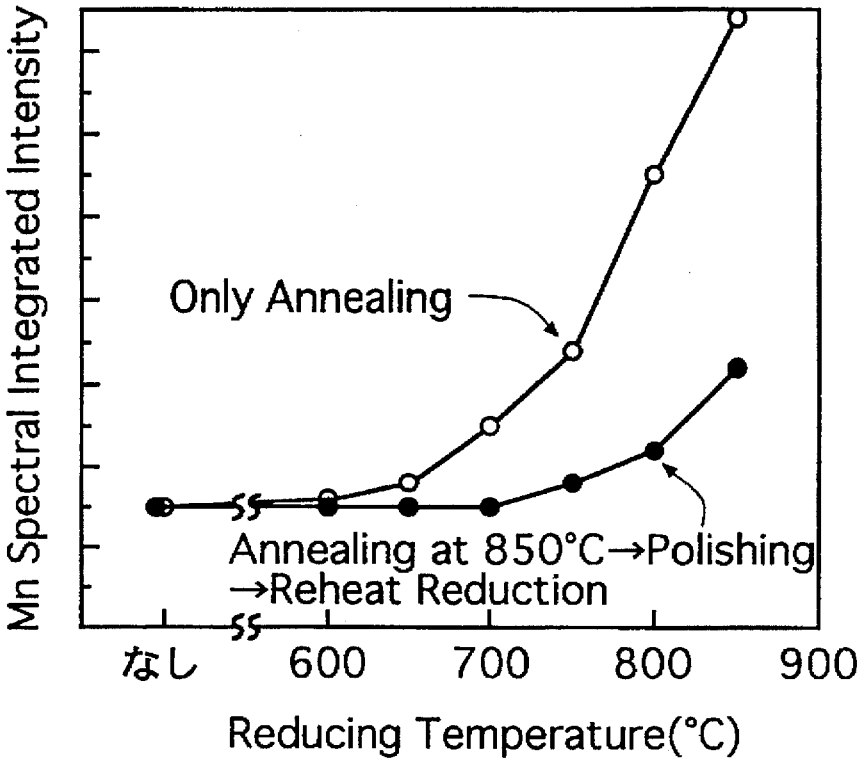
FIG. 2 is a diagram showing the influence of reducing temperature on the surface concentration of Mn.

The method for hot dip galvanizing a high tensile steel strip with minimal bare spots for producing a galvanized or galvannealed steel strip according to the present invention is, when a high tensile steel strip having Si, Mn or Cr added thereto is used as a starting steel strip, a method involving the steps of annealing the steel strip at a recrystallization annealing temperature in a continuous annealing line, cooling the steel strip, removing a steel component concentrated layer at the surface of the steel strip by polishing or pickling or a combination of polishing and pickling, and subjecting the steel strip again to heat reduction at a temperature between 650° C. and a recrystallization temperature and hot dip galvanizing in a continuous galvanizing line; and a method wherein the resulting galvanized steel strip is further subject to an alloying treatment. The heating temperature for alloying should preferably be at least 460° C., because lower temperatures requires, long-term heating which detracts from manufacturing efficiency, and up to 560° C. from the standpoint of insuring plating adhesion upon press working. Further overplating may be applied to the galvanized or galvannealed steel strip if desired.

The invention is described below in further detail.

Described first is a process of carrying out hot dip galvanizing and subsequent alloying on a high tensile steel strip used herein in CAL and CGL. The steel strip used as a basis material to be plated is adjusted in thickness by hot rolling and cold rolling and then annealed at a recrystallization temperature in a CAL. The atmosphere of CAL should be reducing to the steel strip in order to prevent scale generation. $N_2$ gas containing at least 0.5% of $H_2$ or $H_2$ gas can be used, with $N_2$ gas containing 1 to 20%, typically about 5% of $H_2$ being preferably used. The ultimate temperature of the steel strip in the CAL is generally in the range of 750° to 950° C. though it varies with a particular steel component and the intended material quality.

The steel strip annealed at the recrystallization temperature in the CAL has the steel component(s) such as Si, Mn and Cr concentrated at the surface in the form of oxides. After cooling, this surface concentrated layer is removed by polishing or pickling or a combination thereof and thereafter, the steel strip is introduced into a CGL.

Typical means for removing the surface concentrated layer used in the practice of the invention include pickling, polishing and a combination of polishing and pickling.

Pickling as used herein is to chemically dissolve the steel strip surface in a pickling bath. If substantial concentration has occurred at the surface of high tensile steel strip after recrystallization annealing, removal of the surface concentrated layer requires a long time, lowers the line speed and hence manufacturing efficiency, and can increase the roughness (or irregularities) of the steel strip surface, detracting from adhesion and image clarity. Nevertheless, because of simplicity of the equipment used therein, pickling can be advantageously used if the surface concentration is modest. Further where the surface concentration on the steel strip is modest, the pickling time can be shorter pursuant to a degree of surface concentration, with the advantage of avoiding a lowering of line speed.

On the other hand, polishing is to mechanically or physically abrade or scrape off the steel strip surface and requires a complex equipment as compared with the pickling. Even when the surface concentration is modest, some polishing equipment cannot shorten the necessary polishing time pursuant to a degree of surface concentration and requires a certain time. Nevertheless, polishing has advantages of insuring removal of a surface concentrated layer, effecting surface layer removal without a substantial increase of polishing time even when the surface concentration is substantial, and presenting an aesthetic surface finish after removal of the surface concentrated layer.

Furthermore, the combination of polishing and pickling includes any combination of the two steps. Physical removal by polishing may be followed by chemical dissolution of the steel strip surface by pickling; pickling may be followed by polishing, which may be further followed by either polishing or pickling; or polishing and pickling may be alternately repeated. Therefore, the combination of polishing and pickling has the disadvantage of a complex system because two devices for polishing and pickling are necessary, but advantages of ensuring sufficient removal of a surface concentrated layer independent of a degree of surface concentration on the high tensile steel strip and avoiding a lowering of line speed to provide efficient manufacture.

Therefore, when the surface concentrated layer is removed from the high tensile steel strip according to the method of invention, a choice may be made among pickling, polishing and a combination of pickling and polishing pursuant to a degree of surface concentration, system construction, productivity and the like while taking into account the respective functions of pickling, polishing and a combination thereof.

Cooling of the high tensile steel strip after recrystallization annealing is not critical and may be conventional. For example, the steel strip may be cooled to a temperature allowing for polishing or pickling, for example, 0° to 100° C., preferably room temperature to about 80° C. by exposing it to a cold blow of the atmosphere gas of the continuous annealing furnace.

Also, polishing of the high tensile steel strip after recrystallization annealing may be carried out by any method which can remove the surface concentrated layer and is not critical. Exemplary polishing methods include frictional motion of an abrasive laden plastic brush and frictional motion of a metallic wire brush. The abrasives used herein are typically alumina and silica sand. The abrasion depth may be suitably determined in accordance with the thickness of the surface concentrated layer.

Also, pickling of the high tensile steel strip after recrystallization annealing is not critical and may be conventional method. Pickling may be carried out in any conditions which allow for removal of a surface concentrated layer, for example, using a bath of HCl, $H_2SO_4$ or the like.

When HCl is used, for example, pickling conditions include a bath concentration of 2 to 20% by weight, typically 5% by weight, a bath temperature of room temperature to about 80° C., typically 50° C., and a pickling time of 5 to 60 seconds, typically 10 seconds. It is understood that electrolytic pickling may be employed depending on the thickness of a surface concentrated layer.

Where polishing and pickling are used in combination, either of them may be first, but they are preferably effected in succession.

A device for removing a surface concentrated layer can be installed such that (1) it is connected to the outlet of the continuous annealing line (CAL), (2) it is connected to the inlet of the continuous galvanizing line (CGL), (3) it is in a separate line from CAL and CGL, or (4) CAL, the removing device, and CGL are in a common line.

With respect to heat reduction in CGL, about 600° C. is sufficient to allow for galvanizing for hot rolled steel strips having a low content of Si, Mn or Cr, but the effect of improving reactivity with the zinc hot dipping bath and plating wettability develops for cold rolled and then recrystallization annealed steel strips having Si, Mn or Cr added thereto when the reheat reduction temperature exceeds 650° C., with temperatures above 700° C. belonging to a preferred range. However, for preventing recurrent surface concentration and from the standpoint of steel strip material, the preferred reheat reduction temperature is below the recrystallization annealing temperature in CAL (see FIG. 3).

Figure 3:
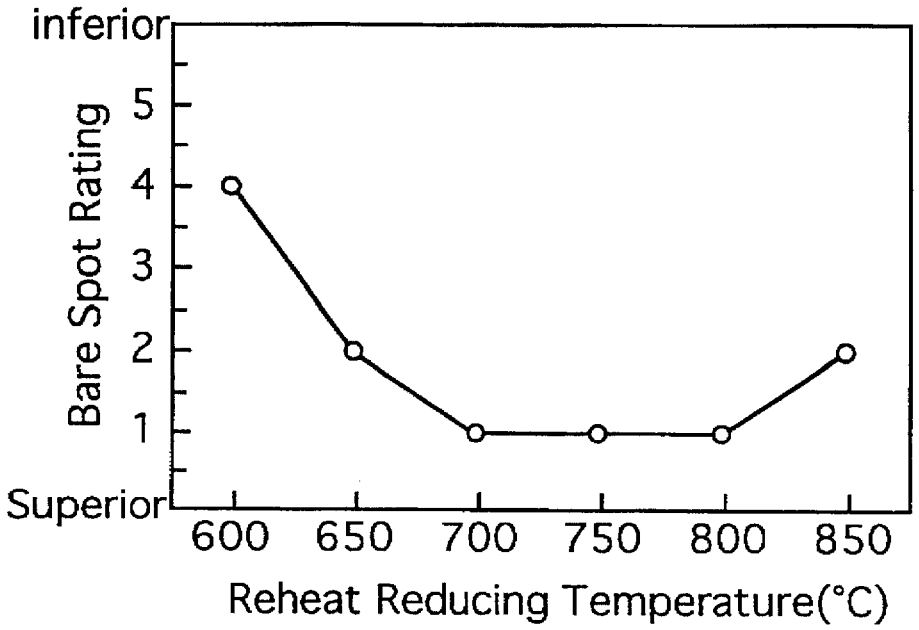
FIG. 3 is a diagram showing the influence of the reheat reducing temperature on bare spots.

Accordingly, the present invention limits the reheat reduction temperature to the range of at least 650° C. and up to the recrystallization annealing temperature. If the reheat reduction temperature is below 650° C., bare spots are left as shown in FIG. 3. Then even if alloying subsequent to the plating could be successfully achieved, the resulting product is unacceptable. If the reheat reduction temperature exceeds the recrystallization annealing temperature, a surface concentrated layer of the steel component is recurrently formed at the steel strip surface to cause bare spots in galvanized coatings with the resulting product being unacceptable. Like CAL, the reheat reducing atmosphere in CGL is not critical as long as it is a reducing atmosphere. $N_2$ gas containing at least 0.5% of $H_2$ or $H_2$ gas can be used, with $N_2$ gas containing 1 to 20%, typically about 5% of $H_2$ being preferably used.

Like conventional hot dip galvanizing, the steel strip which has been subject to annealing reduction again at the above-defined temperature is cooled to a temperature of about 500° C. and then introduced into a zinc hot dipping bath having a concentration of dissolved Al of about 0.12 to 0.20% by weight, preferably about 0.13 to 0.14% by weight at a temperature of about 460° to 500° C. where it is galvanized, whereupon the coating weight is regulated by gas wiping on emergence from the bath. A galvanized steel strip is manufactured in this way. If necessary, the steel strip is immediately thereafter subject to heat alloying treatment to manufacture a galvannealed steel strip. The alloying temperature may be at least 460° C. from the standpoint of productivity and up to 560° C. from the standpoint of plating adhesion upon press working.

After galvanizing or galvannealing, overplating may be carried out to improve the plating properties, if necessary. For example, the overplating may be Fe—Zn or Fe—P plating which is employed for improving sliding motion during press working. The overplating is not critical and may be any desired plating depending on a particular application.

Described below are the additive components in the high tensile steel strip used herein.

Si, Mn and Cr are added for providing steel with strength. P may be additionally contained.

Silicon should be at least 0.1% above which the effect of increasing the steel strength develops and up to 2.0% above which an oxide film is formed at the surface to detract from close contact with the zinc hot dipping bath.

Manganese should be at least 0.5% above which the effect of increasing the steel strength develops and up to 2.0% above which deep drawing is adversely affected.

Chromium should be at least 0.1% above which the effect of increasing the steel strength develops and fall between 0.1% and 2.0% for saturation of the strength improving effect and economy.

Phosphorus may be added if desired since it can impart strength even when added in minor amounts and is relatively inexpensive. Since phosphorus tends to induce secondary working embrittlement and adversely affects deep drawing, it should be up to 0.2% even when it is intentionally added. Since P need not be necessarily added in the present invention, the lower limit need not be set in particular, but may be 0.03% or more when it is intentionally added.

The present invention is significantly effective with steel strips having at least one of Si, Mn, and Cr added thereto. The invention is also effective with steel strips having added thereto P or carbonitride-forming elements which are added to the steel strips for improving shapability, such as Ti and Nb.

Also employable herein are steel strips having added thereto at least one of Si, Mn, and Cr, optionally at least one of P, Ti, and Nb, and additionally B for improving secondary working embrittlement and weldability.

EXAMPLE

Examples of the present invention are given below by way of illustration.

On a laboratory scale, steel strips of 0.7 mm thick were prepared by vacuum melting, hot rolling and cold rolling. For annealing and galvanizing, a vertical CGL simulator was used. For alloying, a resistance heating furnace by direct electric conduction was used. Table 1 shows the composition of steel strips under test.

Previously cleaned steel strips were subject to a treatment consisting solely of annealing according to a prior art method or to treatments of annealing-concentrated layer removal-reheat reduction according to the inventive method before hot dip galvanizing was effected to produce galvanized steel strips. Thereafter, the galvanized steel strips were subject to alloying treatment to produce galvannealed steel strips. The resulting steel strips were examined for plating appearance, iron content of the galvanized layer, and powdering resistance.

Table 2 shows exemplary steel strips wherein hot dip galvanizing was effected after annealing without removing a concentrated layer (prior art method) and exemplary steel strips wherein reheat reduction treatment was effected after annealing and removal of a concentrated layer (inventive method). The annealing conditions, reheat reducing conditions, concentrated surface removing conditions, galvanizing conditions and alloying conditions are described below as well as the methods for evaluating the steel strips.

[Annealing and reheat reducing conditions]

Atmosphere: 5% $H_2$-$N_2$ gas (dew point −20° C.)

Temperature: Table 2

Time: 20 seconds

In the prior art method, the steel strip after annealing was introduced into the zinc hot dipping bath at the time when the steel strip reached a predetermined temperature.

In the inventive method, the steel strip after annealing was once cooled to room temperature, removed of a concentrated layer, again heat reduced, and then introduced into the zinc hot dipping bath at the time when the steel strip was cooled to a predetermined temperature.

[Concentrated layer removing conditions]

Polishing Material: alumina abrasive laden nylon brush

Procedure: longitudinal and transverse 10 reciprocal strokes (frictional motion)

Pickling Hydrochloric acid concentration:

5% HCl aqueous solution

Temperature: 60° C.

Time: 6 seconds

Under these conditions, polishing or pickling or a combination of polishing and pickling was carried out.

[Galvanizing conditions]

Bath Al concentration: 0.13 wt %

Temperature: 475° C.

Strip temperature: 475° C.

Dipping time: 3 seconds

Coating weight: 45 g/m$^2$

[Alloying conditions]

Temperature: Table 2

Time: Table 2

[Evaluation methods]

Judgment of bare spots was by visual observation. A sample free of a bare spot was rated "1" and a sample having most bare spots was rated "5".

The iron content in the galvanized layer was determined by atomic absorption spectrometry after the galvanized layer was dissolved with sulfuric acid.

Powdering resistance was determined by a 90° C. bending test and measuring zinc powder adhered to an adhesive tape by X-ray fluorescence analysis.

The results are shown in Table 2

TABLE 1

Composition of Steel Strips under Test (wt %)

| | C | Si | Mn | P | Cr | S | Ti | Nb | B |
|---|---|---|---|---|---|---|---|---|---|
| A | 0.072 | 0.02 | 1.58 | 0.075 | 0.55 | 0.006 | — | — | — |
| B | 0.065 | 0.02 | 0.95 | 0.017 | — | 0.003 | — | — | — |
| C | 0.0055 | 0.32 | 0.95 | 0.064 | — | 0.007 | — | — | 0.0011 |
| D | 0.004 | 0.1 | 0.2 | 0.10 | — | — | — | — | 0.001 |
| E | 0.004 | 0.7 | 0.2 | 0.15 | — | — | — | — | — |
| F | 0.009 | 0.05 | 1.4 | 0.03 | — | — | — | — | — |
| G | 0.006 | 0.1 | 0.2 | 0.07 | 0.58 | — | — | — | — |

TABLE 1-continued

| | Composition of Steel Strips under Test (wt %) | | | | | | | | |
|---|---|---|---|---|---|---|---|---|---|
| | C | Si | Mn | P | Cr | S | Ti | Nb | B |
| H | 0.003 | 0.3 | 1.0 | 0.07 | — | — | 0.06 | — | 0.001 |
| I | 0.003 | 0.5 | 1.5 | 0.11 | — | — | 0.05 | — | 0.002 |
| J | 0.011 | 1.2 | 0.5 | 0.07 | — | — | 0.03 | 0.01 | — |
| K | 0.071 | 0.1 | 1.8 | 0.08 | — | — | — | — | — |
| L | 0.010 | 0.05 | 0.2 | 0.06 | 0.22 | — | 0.02 | 0.01 | 0.0003 |
| M | 0.0045 | 0.29 | 0.87 | 0.006 | 0.01 | 0.003 | — | — | 0.001 |
| N | 0.0040 | 0.51 | 0.28 | 0.007 | 0.01 | 0.004 | — | — | — |

TABLE 2

| | | Prior art method | Inventive method | | | | | | | | | |
|---|---|---|---|---|---|---|---|---|---|---|---|---|
| | Steel strip used | Annealing temp. °C. | Annealing temp. °C. | Concentrated layer removal | Reheat reducing temp. °C. | Alloying temp. (°C.) | Galvanized coating weight (g/m²) | Iron content of galvanized layer (%) | Over-plating | Powdering resistance (CPS) | Bare spot rating | Classification |
| 1 | A | 820 | — | — | — | — | 60 | — | — | — | 4 | Com. Ex. |
| 2 | B | 820 | — | — | — | — | 60 | — | — | — | 4 | Com. Ex. |
| 3 | C | 850 | — | — | — | — | 60 | — | — | — | 4 | Com. Ex. |
| 4 | A | — | 820 | none | 720 | — | 60 | — | — | — | 5 | Com. Ex. |
| 5 | A | — | 820 | pickling | 680 | — | 60 | — | — | — | 2 | Ex. |
| 6 | A | — | 820 | pickling | 770 | — | 60 | — | — | — | 1 | Ex. |
| 7 | B | — | 820 | pickling | 770 | — | 60 | — | — | — | 1 | Ex. |
| 8 | C | — | 850 | pickling | 700 | — | 60 | — | — | — | 2 | Ex. |
| 9 | C | — | 850 | pickling | 750 | — | 60 | — | — | — | 1 | Ex. |
| 10 | C | — | 850 | pickling | 800 | — | 60 | — | — | — | 1 | Ex. |
| 11 | C | — | 850 | pickling | 850 | — | 60 | — | — | — | 1 | Ex. |
| 12 | C | — | 850 | polishing | 680 | — | 60 | — | — | — | 2 | Ex. |
| 13 | C | — | 850 | polishing | 710 | — | 60 | — | — | — | 1 | Ex. |
| 14 | C | — | 850 | polishing | 750 | — | 60 | — | — | — | 1 | Ex. |
| 15 | C | — | 850 | polishing | 800 | — | 60 | — | — | — | 1 | Ex. |
| 16 | C | — | 850 | polishing | 850 | — | 60 | — | — | — | 2 | Ex. |
| 17 | D | 820 | — | — | — | 560 | 45 | 10.5 | — | 3750 | 4 | Com. Ex. |
| 18 | D | — | 820 | none | 700 | 560 | 45 | 10.8 | — | 4710 | 4 | Com. Ex. |
| 19 | D | — | 820 | polishing | 600 | 520 | 45 | 9.5 | — | 2580 | 3 | Com. Ex. |
| 20 | D | — | 820 | polishing | 650 | 490 | 45 | 9.9 | — | 1660 | 2 | Ex. |
| 21 | D | — | 820 | polishing | 700 | 490 | 45 | 10.8 | — | 2050 | 1 | Ex. |
| 22 | D | — | 820 | polishing | 750 | 490 | 45 | 10.7 | — | 1930 | 1 | Ex. |
| 23 | D | — | 820 | polishing | 800 | 490 | 45 | 10.0 | — | 2310 | 2 | Ex. |
| 24 | D | — | 820 | polishing | 850 | 520 | 45 | 10.0 | — | 3180 | 3 | Com. Ex. |
| 25 | D | — | 820 | pol.→pick. | 600 | 520 | 45 | 10.9 | — | 3270 | 3 | Com. Ex. |
| 26 | D | — | 820 | pol.→pick. | 750 | 490 | 45 | 10.2 | — | 2390 | 1 | Ex. |
| 27 | E | 840 | — | — | — | 580 | 45 | 10.1 | — | 4770 | 5 | Com. Ex. |
| 28 | E | — | 840 | none | 700 | 580 | 45 | 9.1 | — | 4170 | 5 | Com. Ex. |
| 29 | E | — | 840 | polishing | 600 | 560 | 45 | 10.6 | — | 3200 | 4 | Com. Ex. |
| 30 | E | — | 840 | polishing | 700 | 520 | 45 | 10.2 | — | 2350 | 2 | Ex. |
| 31 | E | — | 840 | polishing | 800 | 520 | 45 | 10.5 | — | 2590 | 1 | Ex. |
| 32 | E | — | 840 | pol.→pick. | 700 | 520 | 45 | 9.7 | — | 2000 | 1 | Ex. |
| 33 | F | 820 | — | — | — | 520 | 45 | 9.4 | — | 3550 | 5 | Com. Ex. |
| 34 | F | — | 820 | none | 700 | 520 | 45 | 8.7 | — | 2790 | 5 | Com. Ex. |
| 35 | F | — | 820 | polishing | 650 | 520 | 45 | 10.2 | — | 2490 | 2 | Ex. |
| 36 | F | — | 820 | polishing | 750 | 520 | 45 | 10.6 | — | 2240 | 1 | Ex. |
| 37 | F | — | 820 | polishing | 850 | 520 | 45 | 9.9 | — | 3760 | 3 | Com. Ex. |
| 38 | F | — | 820 | pol.→pick. | 600 | 520 | 45 | 8.5 | — | 1360 | 4 | Com. Ex. |
| 39 | F | — | 820 | pol.→pick. | 700 | 520 | 45 | 10.9 | — | 2810 | 1 | Ex. |
| 40 | F | — | 820 | pol.→pick. | 820 | 520 | 45 | 9.1 | — | 1790 | 2 | Ex. |
| 41 | F | — | 850 | pol.→pick. | 820 | 520 | 45 | 10.6 | — | 2680 | 1 | Ex. |
| 42 | G | 850 | — | — | — | 550 | 45 | 9.7 | — | 3550 | 5 | Com. Ex. |
| 43 | G | — | 850 | polishing | 600 | 550 | 45 | 10.2 | — | 3290 | 3 | Com. Ex. |
| 44 | G | — | 850 | polishing | 700 | 500 | 45 | 9.7 | — | 1750 | 1 | Ex. |
| 45 | G | — | 850 | polishing | 800 | 500 | 45 | 9.5 | — | 1890 | 1 | Ex. |
| 46 | G | — | 850 | polishing | 900 | 550 | 45 | 9.0 | — | 2950 | 3 | Com. Ex. |
| 47 | G | — | 850 | pol.→pick. | 800 | 500 | 45 | 10.5 | — | 2390 | 1 | Ex. |
| 48 | H | 850 | — | — | — | 570 | 45 | 9.3 | — | 3650 | 5 | Com. Ex. |
| 49 | H | — | 850 | polishing | 600 | 530 | 45 | 9.8 | — | 3310 | 4 | Com. Ex. |
| 50 | H | — | 850 | polishing | 650 | 530 | 45 | 9.5 | — | 3050 | 3 | Ex. |
| 51 | H | — | 850 | polishing | 700 | 500 | 45 | 9.7 | — | 1630 | 2 | Ex. |
| 52 | H | — | 850 | polishing | 750 | 490 | 45 | 10.1 | — | 2090 | 1 | Ex. |

TABLE 2-continued

| | Steel strip used | Prior art method Annealing temp. °C. | Inventive method Annealing temp. °C. | Concentrated layer removal | Reheat reducing temp. °C. | Alloying temp. (°C.) | Galvanized coating weight (g/m²) | Iron content of galvanized layer (%) | Overplating | Powdering resistance (CPS) | Bare spot rating | Classification |
|---|---|---|---|---|---|---|---|---|---|---|---|---|
| 53 | H | — | 850 | polishing | 750 | 490 | 45 | 10.1 | Fe—Zn | 2450 | 1 | Ex. |
| 54 | H | — | 850 | polishing | 750 | 490 | 45 | 10.1 | Fe—P | 2010 | 1 | Ex. |
| 55 | H | — | 850 | polishing | 800 | 500 | 45 | 10.6 | — | 2380 | 1 | Ex. |
| 56 | H | — | 850 | polishing | 850 | 500 | 45 | 10.9 | — | 2580 | 2 | Ex. |
| 57 | I | 880 | — | — | — | 600 | 45 | 10.8 | — | 5840 | 5 | Com. Ex. |
| 58 | I | — | 880 | polishing | 600 | 570 | 45 | 10.6 | — | 4360 | 4 | Com. Ex. |
| 59 | I | — | 880 | polishing | 700 | 510 | 45 | 9.1 | — | 1570 | 2 | Ex. |
| 60 | I | — | 880 | polishing | 800 | 510 | 45 | 9.8 | — | 1930 | 1 | Ex. |
| 61 | I | — | 880 | polishing | 900 | 600 | 45 | 11.0 | — | 3880 | 3 | Com. Ex. |
| 62 | I | — | 880 | pol.→pick. | 600 | 600 | 45 | 10.6 | — | 3610 | 4 | Com. Ex. |
| 63 | I | — | 880 | pol.→pick. | 700 | 510 | 45 | 9.8 | — | 2130 | 1 | Ex. |
| 64 | I | — | 880 | pol.→pick. | 800 | 510 | 45 | 9.9 | — | 2020 | 1 | Ex. |
| 65 | I | — | 880 | pol.→pick. | 900 | 600 | 45 | 10.8 | — | 4110 | 3 | Com. Ex. |
| 66 | I | — | 880 | pick.→pol. | 600 | 600 | 45 | 10.6 | — | 3340 | 4 | Com. Ex. |
| 67 | I | — | 880 | pick.→pol. | 700 | 510 | 45 | 9.1 | — | 1570 | 2 | Ex. |
| 68 | I | — | 880 | pick.→pol. | 800 | 510 | 45 | 9.8 | — | 1930 | 1 | Ex. |
| 69 | I | — | 880 | pick.→pol. | 900 | 600 | 45 | 10.4 | — | 2870 | 3 | Com. Ex. |
| 70 | J | 900 | — | — | — | 570 | 45 | 9.0 | — | 3460 | 5 | Com. Ex. |
| 71 | J | — | 900 | polishing | 600 | 570 | 45 | 8.5 | — | 2550 | 4 | Com. Ex. |
| 72 | J | — | 900 | polishing | 700 | 520 | 45 | 9.6 | — | 2850 | 3 | Ex. |
| 73 | J | — | 900 | polishing | 800 | 520 | 45 | 10.1 | — | 2630 | 1 | Ex. |
| 74 | J | — | 900 | polishing | 900 | 520 | 45 | 9.8 | — | 2360 | 2 | Ex. |
| 75 | K | 840 | — | — | — | 550 | 45 | 10.1 | — | 4690 | 5 | Com. Ex. |
| 76 | K | — | 840 | none | 800 | 550 | 45 | 9.0 | — | 3760 | 5 | Com. Ex. |
| 77 | K | — | 840 | polishing | 700 | 490 | 45 | 9.6 | — | 1850 | 1 | Ex. |
| 78 | K | — | 840 | polishing | 800 | 490 | 45 | 10.2 | — | 2490 | 1 | Ex. |
| 79 | K | — | 840 | polishing | 850 | 490 | 45 | 9.6 | — | 2440 | 3 | Com. Ex. |
| 80 | K | — | 840 | pol.→pick. | 700 | 490 | 45 | 10.1 | — | 2230 | 1 | Ex. |
| 81 | K | — | 840 | pol.→pick. | 800 | 490 | 45 | 10.4 | — | 2690 | 1 | Ex. |
| 82 | K | — | 840 | pol.→pick. | 850 | 490 | 45 | 6.3 | — | 1610 | 4 | Com. Ex. |
| 83 | L | 850 | — | — | — | 580 | 45 | 9.7 | — | 3660 | 5 | Com. Ex. |
| 84 | L | — | 850 | none | 750 | 580 | 45 | 8.0 | — | 1900 | 5 | Com. Ex. |
| 85 | L | — | 850 | polishing | 600 | 530 | 45 | 10.6 | — | 3390 | 4 | Com. Ex. |
| 86 | L | — | 850 | polishing | 700 | 530 | 45 | 10.8 | — | 2690 | 1 | Ex. |
| 87 | L | — | 850 | polishing | 800 | 530 | 45 | 10.6 | — | 2430 | 1 | Ex. |
| 88 | L | — | 850 | polishing | 850 | 530 | 45 | 10.4 | — | 2890 | 2 | Ex. |
| 89 | L | — | 850 | pol.→pick. | 600 | 580 | 45 | 10.1 | — | 3150 | 4 | Com. Ex. |
| 90 | L | — | 850 | pol.→pick. | 800 | 530 | 45 | 10.9 | — | 2270 | 1 | Ex. |
| 91 | L | — | 850 | pol.→pick. | 850 | 530 | 45 | 9.9 | — | 2140 | 2 | Ex. |
| 92 | E | 820 | — | — | — | 570 | 45 | 11.0 | — | 4450 | 5 | Com. Ex. |
| 93 | E | — | 820 | none | 700 | 570 | 45 | 10.8 | — | 4710 | 5 | Com. Ex. |
| 94 | E | — | 820 | pickling | 600 | 550 | 45 | 10.5 | — | 4150 | 5 | Com. Ex. |
| 95 | E | — | 820 | pickling | 650 | 500 | 45 | 9.9 | — | 2060 | 3 | Ex. |
| 96 | E | — | 820 | pickling | 700 | 500 | 45 | 10.5 | — | 2150 | 1 | Ex. |
| 97 | E | — | 820 | pickling | 700 | 500 | 45 | 10.5 | Fe—Zn | 2450 | 1 | Ex. |
| 98 | E | — | 820 | pickling | 750 | 500 | 45 | 10.0 | — | 2310 | 1 | Ex. |
| 99 | E | — | 820 | pickling | 750 | 500 | 45 | 10.0 | Fe—P | 2380 | 1 | Ex. |
| 100 | E | — | 820 | pickling | 800 | 530 | 45 | 10.9 | — | 2580 | 3 | Ex. |
| 101 | F | 840 | — | — | — | 570 | 45 | 9.8 | — | 3840 | 5 | Com. Ex. |
| 102 | F | — | 840 | none | 750 | 570 | 45 | 7.6 | — | — | 5 | Com. Ex. |
| 103 | F | — | 840 | pickling | 650 | 560 | 45 | 10.1 | — | 2270 | 3 | Ex. |
| 104 | F | — | 840 | pickling | 750 | 510 | 45 | 9.6 | — | 1900 | 1 | Ex. |
| 105 | F | — | 840 | pickling | 800 | 530 | 45 | 10.2 | — | 2350 | 2 | Ex. |
| 106 | F | — | 840 | pickling | 850 | 530 | 45 | 6.0 | — | — | 4 | Com. Ex. |
| 107 | G | 820 | — | — | — | 560 | 45 | 11.1 | — | 4650 | 5 | Com. Ex. |
| 108 | G | — | 820 | pickling | 600 | 540 | 45 | 10.4 | — | 4550 | 4 | Com. Ex. |
| 109 | G | — | 820 | pickling | 700 | 540 | 45 | 10.2 | — | 2490 | 2 | Ex. |
| 110 | G | — | 820 | pickling | 750 | 500 | 45 | 10.2 | — | 2090 | 1 | Ex. |
| 111 | G | — | 820 | pickling | 800 | 500 | 45 | 8.2 | — | 1780 | 2 | Ex. |
| 112 | H | 850 | — | — | — | 580 | 45 | 9.9 | — | 3760 | 5 | Com. Ex. |
| 113 | H | — | 850 | none | 750 | 580 | 45 | 9.1 | — | 3470 | 5 | Com. Ex. |
| 114 | H | — | 850 | pickling | 600 | 560 | 45 | 4.9 | — | — | 4 | Com. Ex. |
| 115 | H | — | 850 | pickling | 700 | 520 | 45 | 9.1 | — | 1770 | 2 | Ex. |
| 116 | H | — | 850 | pickling | 750 | 520 | 45 | 10.6 | — | 2680 | 1 | Ex. |
| 117 | H | — | 850 | pickling | 800 | 520 | 45 | 9.7 | — | 2550 | 1 | Ex. |
| 118 | H | — | 850 | pickling | 850 | 520 | 45 | 9.5 | — | 2890 | 3 | Ex. |
| 119 | I | 900 | — | — | — | 560 | 45 | 9.3 | — | 3650 | 4 | Com. Ex. |
| 120 | I | — | 900 | none | 800 | 570 | 45 | 9.8 | — | 3910 | 5 | Com. Ex. |
| 121 | I | — | 900 | pickling | 600 | 530 | 45 | 9.5 | — | 3150 | 5 | Com. Ex. |
| 122 | I | — | 900 | pickling | 650 | 500 | 45 | 8.8 | — | 1530 | 3 | Ex. |
| 123 | I | — | 900 | pickling | 750 | 480 | 45 | 10.1 | — | 1850 | 2 | Ex. |

TABLE 2-continued

| | Steel strip used | Prior art method Annealing temp. °C. | Inventive method Annealing temp. °C. | Concentrated layer removal | Reheat reducing temp. °C. | Alloying temp. (°C.) | Galvanized coating weight (g/m²) | Iron content of galvanized layer (%) | Overplating | Powdering resistance (CPS) | Bare spot rating | Classification |
|---|---|---|---|---|---|---|---|---|---|---|---|---|
| 124 | I | — | 900 | pickling | 750 | 520 | 45 | 10.7 | — | 2450 | 1 | Ex. |
| 125 | I | — | 900 | pickling | 800 | 480 | 45 | 9.9 | — | 1910 | 1 | Ex. |
| 126 | I | — | 900 | pickling | 800 | 500 | 45 | 10.6 | — | 2380 | 1 | Ex. |
| 127 | I | — | 900 | pickling | 850 | 500 | 45 | 10.9 | — | 2580 | 2 | Ex. |
| 128 | J | 820 | — | — | — | 540 | 45 | 9.8 | — | 3840 | 5 | Com. Ex. |
| 129 | J | — | 820 | pickling | 600 | 540 | 45 | 9.6 | — | 2360 | 4 | Com. Ex. |
| 130 | J | — | 820 | pickling | 700 | 500 | 45 | 10.1 | — | 2070 | 2 | Ex. |
| 131 | J | — | 820 | pickling | 800 | 480 | 45 | 8.8 | — | 1530 | 1 | Ex. |
| 132 | J | — | 820 | pickling | 850 | 480 | 45 | 3.9 | — | — | 5 | Com. Ex. |
| 133 | K | 800 | — | — | — | 540 | 45 | 6.0 | — | — | 5 | Com. Ex. |
| 134 | K | — | 800 | pickling | 600 | 540 | 45 | 10.0 | — | 2760 | 4 | Com. Ex. |
| 135 | K | — | 800 | pickling | 750 | 500 | 45 | 9.6 | — | 1850 | 1 | Ex. |
| 136 | K | — | 800 | pickling | 750 | 500 | 45 | 9.6 | Fe—Zn | 2030 | 1 | Ex. |
| 137 | K | — | 800 | pickling | 800 | 500 | 45 | 9.1 | — | 2360 | 2 | Ex. |
| 138 | L | 840 | — | — | — | 540 | 45 | 6.0 | — | — | 5 | Com. Ex. |
| 139 | L | — | 840 | pickling | 600 | 540 | 45 | 10.0 | — | 2760 | 4 | Com. Ex. |
| 140 | L | — | 840 | pickling | 750 | 490 | 45 | 9.6 | — | 1850 | 1 | Ex. |
| 141 | L | — | 840 | pickling | 800 | 500 | 45 | 10.2 | — | 2490 | 1 | Ex. |
| 142 | M | 850 | — | — | — | 550 | 55 | 10.5 | — | 3750 | 4 | Com. Ex. |
| 143 | M | — | 850 | none | 700 | 550 | 58 | 10.8 | — | 4710 | 5 | Com. Ex. |
| 144 | M | — | 850 | polishing | 600 | 520 | 61 | 9.5 | — | 2980 | 4 | Com. Ex. |
| 145 | M | — | 850 | polishing | 650 | 490 | 48 | 9.9 | — | 1660 | 2 | Ex. |
| 146 | M | — | 850 | polishing | 700 | 490 | 55 | 10.8 | — | 2050 | 1 | Ex. |
| 147 | M | — | 850 | polishing | 750 | — | 85 | 0.6 | — | 0 | 1 | Ex. |
| 148 | M | — | 850 | polishing | 750 | 490 | 51 | 10.7 | — | 1930 | 1 | Ex. |
| 149 | M | — | 850 | polishing | 800 | 490 | 50 | 10.9 | — | 0 | 1 | Ex. |
| 150 | M | — | 850 | polishing | 850 | 520 | 58 | 10.0 | — | 2180 | 1 | Ex. |
| 151 | M | — | 850 | polishing | 900 | 520 | 61 | 10.9 | — | 3770 | 3 | Com. Ex. |
| 152 | N | 880 | — | — | — | 550 | 61 | 10.1 | — | 4270 | 5 | Com. Ex. |
| 153 | N | — | 880 | none | 700 | 550 | 60 | 9.1 | — | 3570 | 5 | Com. Ex. |
| 154 | N | — | 880 | polishing | 600 | 550 | 58 | 10.6 | — | 4200 | 3 | Com. Ex. |
| 155 | N | — | 880 | polishing | 700 | 550 | 55 | 10.2 | — | 2350 | 1 | Ex. |
| 156 | N | — | 880 | pickling | 700 | 550 | 53 | 9.7 | — | 2000 | 1 | Ex. |
| 157 | N | — | 880 | polishing | 800 | 550 | 58 | 10.5 | — | 2590 | 1 | Ex. |

INDUSTRIAL APPLICABILITY

As mentioned above, the present invention allows for manufacture of galvanized steel strips without bare spots even from high tensile steel strips containing Si, Mn, Cr, etc. which are difficult to plate by hot dip galvanizing. Complication of the manufacturing line and a lowering of productivity are avoided. Since the present invention can use the existing line to achieve these advantages, it has another advantage of eliminating a need for plant investment.

We claim:

1. A method for zinc hot dip coating a high tensile steel strip, wherein said high tensile steel strip has an exposed surface area intended to be treated and is characterized by having a known recrystallization temperature, said high tensile steel strip containing oxidizable strengthening elements which tend to cause bare spots in a zinc coating, the steps which comprise:

cold rolling a high tensile steel containing at least one oxidizable strengthening component selected from the group consisting of 0.1–2.0 wt % Si, 0.5–2.0 wt % Mn and 0.1–2.0 wt % Cr to form a cold rolled steel strip;

recrystallization annealing said cold rolled high tensile steel strip under a reducing atmosphere in a continuous annealing line to form an annealed high tensile steel strip;

cooling said annealed high tensile steel strip to produce an oxide film at said surface of said annealed high tensile steel strip, said oxide film comprising an oxide of said oxidizable strengthening component;

removing said oxide film from said surface of said annealed high tensile steel strip;

heating the resulting high tensile steel strip in a reducing atmosphere at a temperature between 650° C. and said recrystallization temperature; and zinc hot dip coating the thus reduced high tensile steel strip in a continuous galvanizing line.

2. A method according to claim 1 wherein the step of removing said oxide film is pickling.

3. A method according to claim 1 wherein the step of removing said oxide film is polishing.

4. A method according to claim 1 wherein the step of removing said oxide film is polishing and pickling.

5. A method according to claim 1 further comprising overplating said zinc hot dip coated steel strip.

6. A method according to claim 5 further comprising alloying said overplated zinc hot dip coated steel strip.

7. A method according to claim 1 further comprising alloying said zinc hot dip coated steel strip.

8. A method according to claim 7 further comprising overplating said alloyed zinc hot dip coated steel strip.

9. A method for zinc hot dip coating a high tensile steel strip, wherein said high tensile steel strip has an exposed surface area intended to be treated and is characterized by having a known recrystallization temperature, said high tensile steel strip containing oxidizable strengthening elements which tend to cause bare spots in a zinc coating, the steps which comprise:

cold rolling a high tensile steel containing at least one oxidizable strengthening component selected from the group consisting of 0.1–2.0 wt % Si, 0.5–2.0 wt % Mn and 0.1–2.0 wt % Cr, said high tensile steel further containing up to 0.2 wt % P, to form a cold rolled high tensile steel strip;

recrystallization annealing said cold rolled high tensile steel strip under a reducing atmosphere in a continuous annealing line to form an annealed high tensile steel strip;

cooling said annealed high tensile steel strip to produce an oxide film at said surface of said annealed high tensile steel strip, said oxide film comprising an oxide of said oxidizable strengthening component;

removing said oxide film from said surface of said annealed high tensile steel strip;

heating the resulting high tensile steel strip in a reducing atmosphere at a temperature between 650° C. and said recrystallization temperature; and zinc hot dip coating the thus reduced high tensile steel strip in a continuous galvanizing line.

10. A method according to claim 9 wherein the step of removing said oxide film is pickling.

11. A method according to claim 9 wherein the step of removing said oxide film is polishing.

12. A method according to claim 9 wherein the step of removing said oxide film is polishing and pickling.

13. A method according to claim 9 further comprising overplating said zinc hot dip coated steel strip.

14. A method according to claim 13 further comprising alloying said overplated zinc hot dip coated steel strip.

15. A method according to claim 9 further comprising alloying said zinc hot dip coated steel strip.

16. A method according to claim 9 further comprising overplating said alloyed zinc hot dip coated steel strip.

* * * * *

UNITED STATES PATENT AND TRADEMARK OFFICE

CERTIFICATE OF CORRECTION

PATENT NO. : 5,677,005

DATED : October 14, 1997

INVENTOR(S) : Makoto Isobe, Nobue Fujibayashi, Kazuaki Kyono, Nobuo Totsuka and Nobuyuki Morito It is certified that error appears in the above-indentified patent and that said Letters Patent is hereby corrected as shown below:

In Column 3, line 5, please delete "time".

In Column 4, line 49, please change "requires," to --require--.

In Column 11, Table 2-continued, column 9 (Iron content of galvanized layer (%)), line 30, please change "6.3" to --8.3--.

Signed and Sealed this

Sixth Day of January, 1998

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,677,005

DATED : October 14, 1997

INVENTOR(S) : Makoto Isobe et al

It is certified that error appears in the above-indentified patent and that said Letters Patent is hereby corrected as shown below:

In Column 16, line 17, please change "9" to --15--.

Signed and Sealed this

Twentieth Day of June, 2000

*Attest:*

Q. TODD DICKINSON

*Attesting Officer*

*Director of Patents and Trademarks*